US007928668B2

(12) United States Patent
Huang et al.

(10) Patent No.: US 7,928,668 B2
(45) Date of Patent: Apr. 19, 2011

(54) LAMP CONTROL SYSTEM

(75) Inventors: Wei-Chi Huang, Hsinchu (TW); Chi-Hsiung Lee, Hsinchu (TW)

(73) Assignee: Ampower Technology Co., Ltd., Jhongli, Taoyuan County (TW)

( * ) Notice: Subject to any disclaimer, the term of this patent is extended or adjusted under 35 U.S.C. 154(b) by 402 days.

(21) Appl. No.: 12/255,647

(22) Filed: Oct. 21, 2008

(65) Prior Publication Data

US 2009/0284173 A1 Nov. 19, 2009

(30) Foreign Application Priority Data

May 16, 2008 (CN) ..... 2008 1 0067275

(51) Int. Cl.
*H05B 37/02* (2006.01)

(52) U.S. Cl. ..... 315/294; 315/313

(58) Field of Classification Search ..... 315/268, 315/269, 274, 276, 294–296, 307, 312, 313
See application file for complete search history.

(56) References Cited

U.S. PATENT DOCUMENTS

| | | | | |
|---|---|---|---|---|
| 6,680,588 | B2 * | 1/2004 | Park et al. | 315/312 |
| 6,947,024 | B2 * | 9/2005 | Lee et al. | 345/102 |
| 6,963,179 | B2 * | 11/2005 | Yu et al. | 315/318 |
| 7,285,925 | B2 * | 10/2007 | Chen et al. | 315/312 |
| 7,365,500 | B2 * | 4/2008 | Jang | 315/274 |

* cited by examiner

*Primary Examiner* — Don P Le
(74) *Attorney, Agent, or Firm* — Frank R. Niranjan

(57) ABSTRACT

A lamp control system driving at least two discharge lamps according to at least two control instructions includes a control circuit, a switch circuit, a transformer resonance circuit, and a source transformer circuit. The control circuit generates a control signal to which the source transformer circuit is electrically connected, transforming the control signal to at least one alternating current (AC) signal, and the transformer resonance circuit is electrically connected to the source transformer circuit and the discharge lamps, transforming the at least one AC signal to one or more electrical signals to respectively drive one or more discharge lamps, the switch circuit, electrically connected to the source transformer circuit and the transformer resonance circuit, drives source transformer circuit output of the at least one AC signals to the transformer resonance circuit.

6 Claims, 5 Drawing Sheets

LAMP CONTROL SYSTEM

BACKGROUND

1. Field of the Invention

The disclosure relates to lamp control, and more particularly, to a lamp control system of a liquid crystal display (LCD) system.

2. Description of related art

Discharge lamps, such as cold cathode fluorescent lamps (CCFLs), are often used as light sources in LCD panels. Generally, the CCFL is driven by an alternating current (AC) signal generated by an inverter circuit.

Two or more pairs of CCFLs are employed to illuminate a large LCD panel for providing sufficient brightness. Thus, the inverter circuit normally has many groups of outputs to generate sufficient AC signals to drive the CCFLs. However, the inverter circuit is usually controlled by one group of input control signals for generating many groups of synchronous and the same output signals.

Referring to FIG. 1, a lamp control system 10 receives a switch signal, and transforms the switch signal to two groups of uniform electrical signals to drive the first lamp 10A and the second lamp 10B simultaneously. The first lamp 10A and the second lamp 10B are controlled by the electrical signals, and are lit or extinguished simultaneously. If there is a requirement to lower brightness of the LCD panel (not shown) employing the lamp control system 10, only one lamp needs to be lit at a time. The lamp control system 10 cannot fully illuminate the LCD panel while lowering its brightness level to conserve power consumption.

SUMMARY

According to the requirements related to the foregoing descriptions, it is necessary to provide a lamp control system which can meet the requirements of brightness and conservation of energy consumption simultaneously when the LCD panel is required to lower its brightness level.

According to an exemplary embodiment of the disclosure, a lamp control system controlling a plurality of lamps includes a control circuit, a source transformer circuit, a transformer resonance circuit, and a switch circuit. The control circuit receives a group of switch signals and transforms the switch signals to a control signal. The source transformer circuit is electrically connected to the control circuit and transforms the control signal to at least one AC signal. The transformer resonance circuit is electrically connected between the source transformer circuit and the lamps, and transforms the at least one AC signal to one or more electrical signals to drive the lamps. The switch circuit is electrically connected to the source transformer circuit and controls the source transformer circuit to output the at least one AC signal to the transformer resonance circuit. Accordingly, the transformer resonance circuit is directed to output the one or more electrical signals to drive the one or more lamps.

Other advantages and novel features of the disclosure will be apparent from the following detailed description of preferred embodiments thereof with references to the attached drawings, in which:

DETAILED DESCRIPTION OF THE EMBODIMENTS

Figure 1:
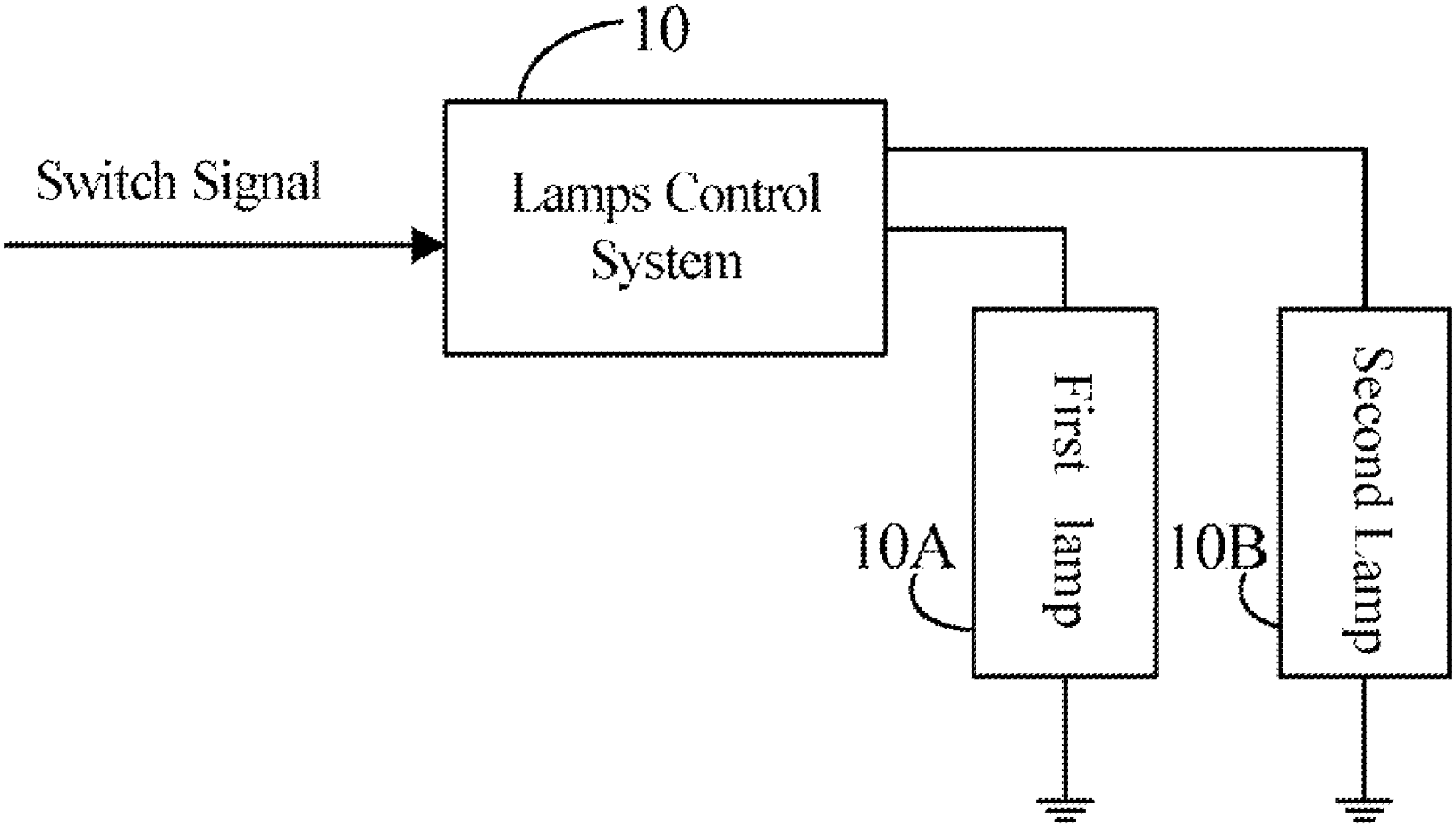
FIG. 1 (PRIOR ART)
FIG. 1 is a schematic diagram of an application of an existing lamp control system.
Figure 2:
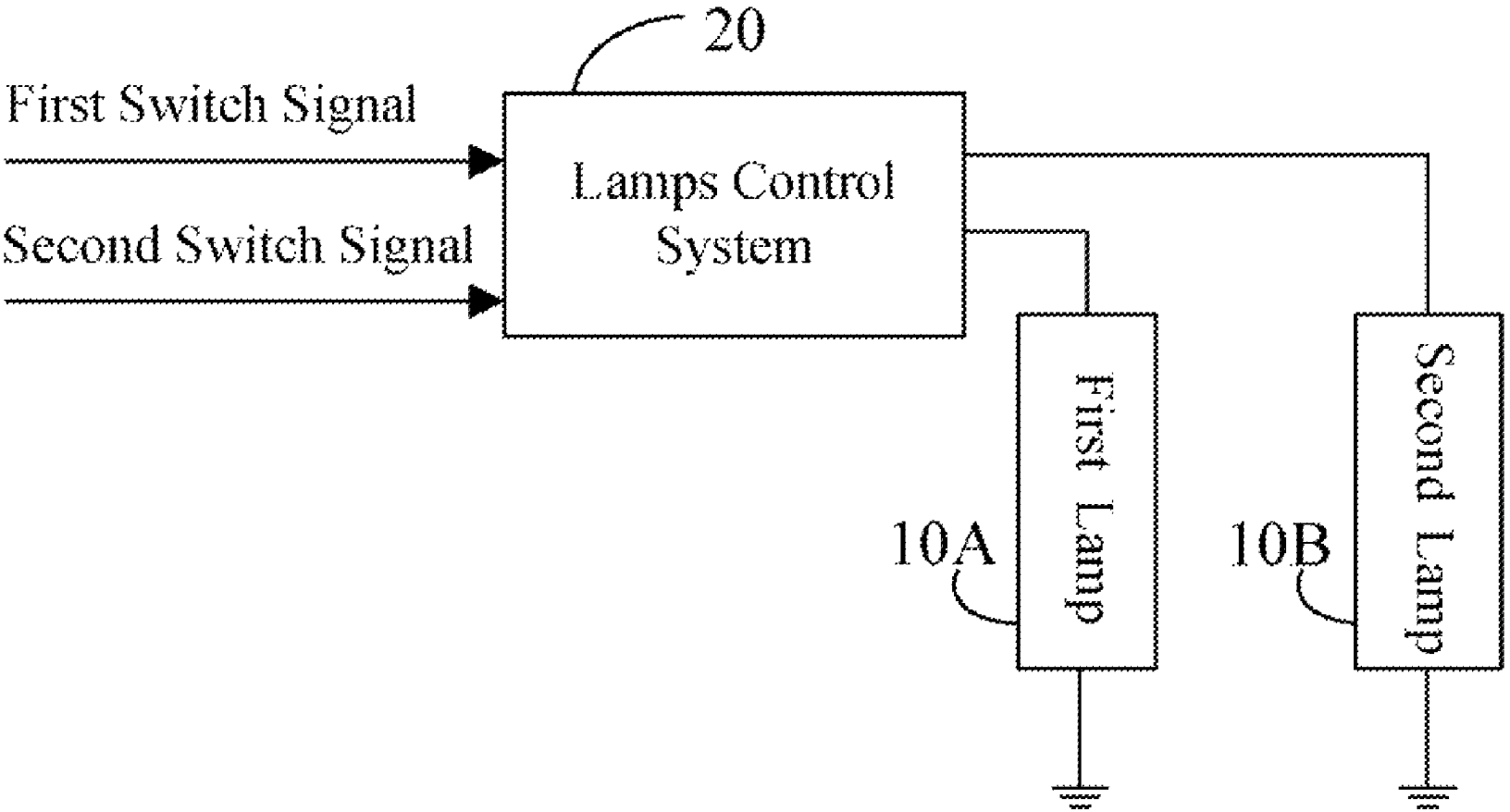
FIG. 2 is a schematic diagram of an application infrastructure of a lamp control system of the disclosure.

FIG. 2 is a schematic diagram of an application infrastructure of a lamp control system 20 of the disclosure. A first discharge lamp 10A and a second discharge lamp 10B are electrically connected to the lamp control system 20. The lamp control system 20 receives a first switch signal and a second switch signal, and outputs a first electrical signal and a second electrical signal accordingly to drive the first lamps 10A and the second lamp 10B, respectively.

Figure 3:
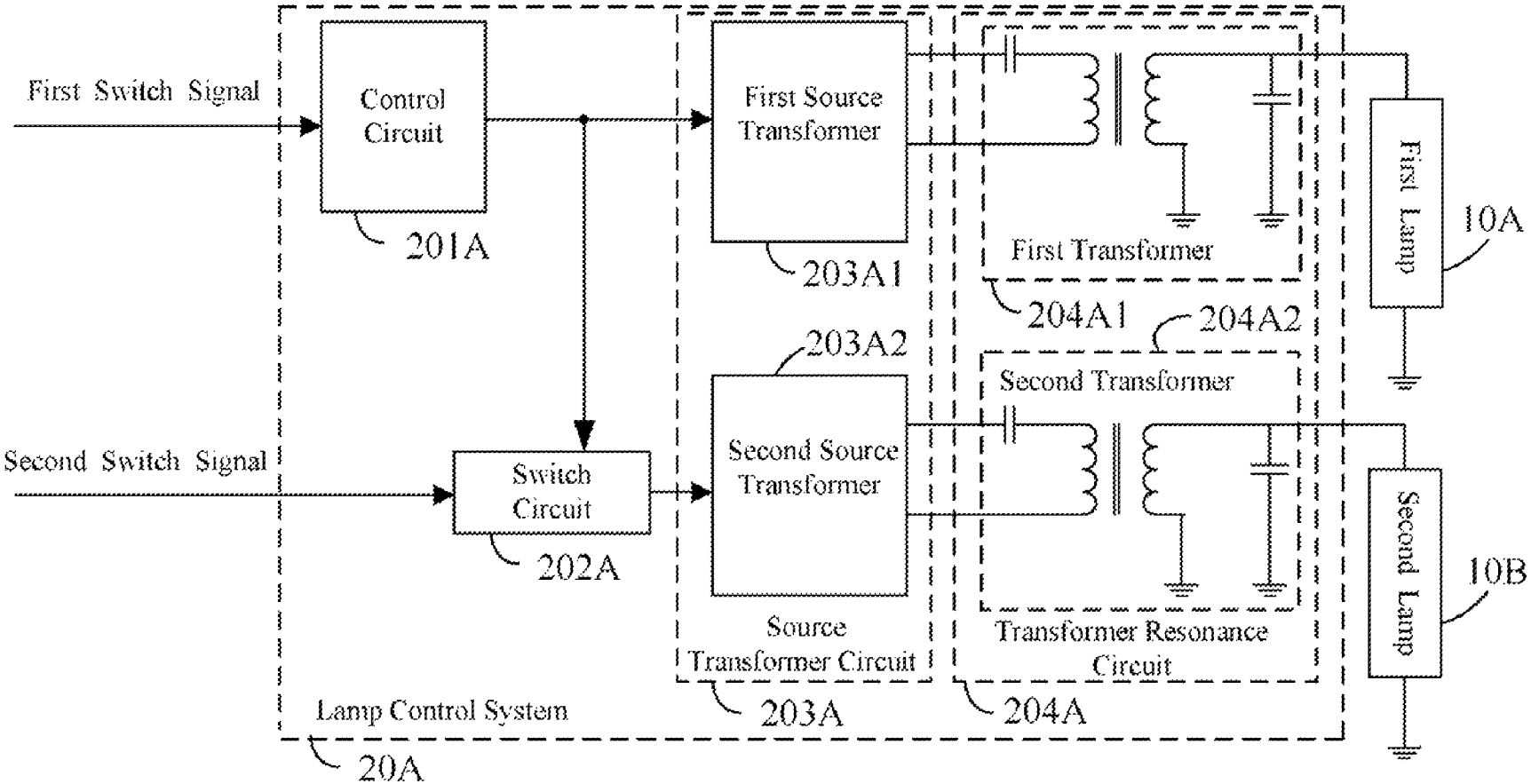
FIG. 3 is a function module diagram of an exemplary embodiment of the disclosure.

FIG. 3 shows function modules of an exemplary embodiment of a lamp control system 20A. In the exemplary embodiment, a first lamp 10A and a second lamp 10B are electrically connected to the lamp control system 20A. The lamps 10A, 10B may be CCFLs.

The lamp control system 20A includes a control circuit 201A, a switch circuit 202A, a source transformer circuit 203A and a transformer resonance circuit 204A. In the exemplary embodiment, the control circuit 201A receives a first switch signal, subsequently transforming the first switch signal to a control signal. The first switch signal can be a digital square wave signal or a power source signal, such as a direct current (DC) signal. The switch circuit 202A is electrically connected to the control circuit 201A to control output of the control signal to the transformer circuit 203A according to a second switch signal.

The source transformer circuit 203A is electrically connected to the control circuit 201A and the switch circuit 202A, and comprises a first source transformer 203A1 and a second source transformer 203A2. The first source transformer 203A1 is electrically connected to the control circuit 201A, and transforms the control signal to a first AC signal. The second source transformer 203A2 is electrically connected to the control circuit 201A through the switch circuit 202A, and transforms the control signal transmitted by the switch circuit 202A to a second AC signal.

The transformer resonance circuit 204A includes a first transformer 204A1 and a second transformer 204A2. A primary winding of the first transformer 204A1 is electrically connected to the first source transformer 203A1, while a secondary winding of the first transformer 204A1 is electrically connected the first lamp 10A. Therefore, the first AC signal is transformed to a first electrical signal to drive the first lamp 10A. A primary winding of the second transformer 204A2 is electrically connected to the second source transformer 203A2, while a secondary winding of the second transformer 204A2 is electrically connected to the second lamp 10B. Therefore, the second AC signal is transformed to a second electrical signal to drive the second lamp 10B.

Figure 4:
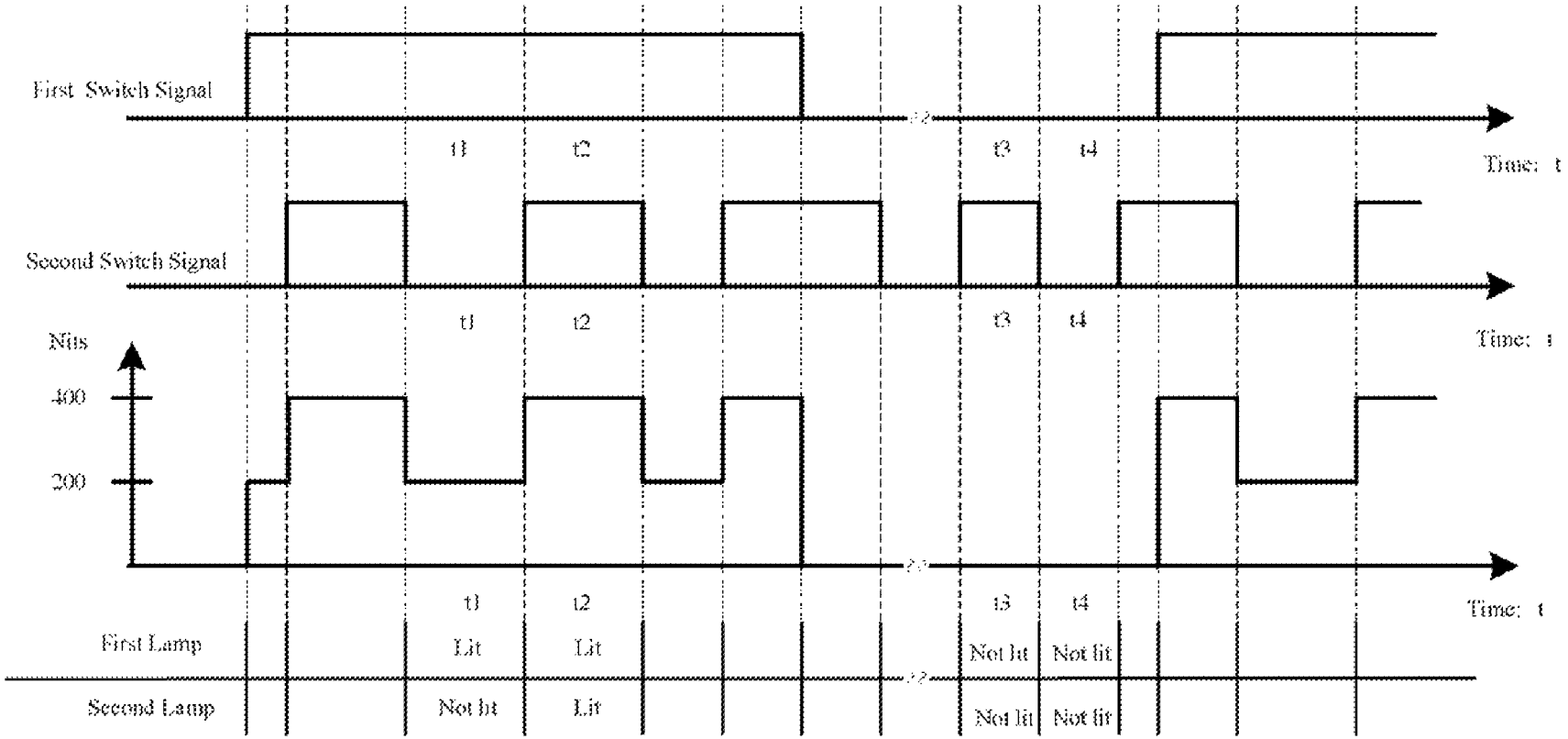
FIG. 4 is an application effect schematic diagram of FIG. 3.

Referring to FIG. 4, a schematic diagram of application of an embodiment of the disclosure is shown. For instance, the highest level of brightness of each lamp is assumed as 200 Nits. At time t1, the first switch signal is valid and the second switch signal is invalid, the switch circuit 202A disconnects the electrical connection between the second source transformer 203A2 and the control circuit 201A, and the control signal is not transmitted to the second source transformer 203A2. As a result, only the first lamp 10A is lit.

At time t2, both the first and second switch signals are valid, the electrical connection between the second source transformer 203A2 and the control circuit 201A is enabled and the control signal is also transmitted to the second source transformer 203A2 through the switch circuit 202A. Accordingly, the first transformer 204A1 and the second transformer 204A2 transform the AC signals output from the source transformer circuit 203A1 and the second source transformer 203A2 to the electrical signals to drive the lamps, respectively. Consequently, the first lamp 10A and the second lamp 10B are both lit.

At time t3, the first switch signal is invalid and the second switch signal is valid. In this state, there are no control signals transmitted to the first source transformer 203A1 and the second source transformer 203A2. Accordingly, there are no signals transmitted to the first transformer 204A1 and the second transformer 204A2. Consequently, neither the first lamp 10A nor the second lamp 10B is lit.

At time t4, the first switch signal and the second switch signal are both invalid. In this state, there are also no control signals transmitted to the source transformer 203A1 and the second source transformer 203A2. Accordingly, there are no signals transmitted to the first transformer 204A1 and the second transformer 204A2. Consequently, neither the first lamp 10A nor the second lamp 10B is further lit.

From the foregoing descriptions, it is concluded that the first switch signal controls whether all lamps are lit or not, and the second switch signal controls only the second lamp. That is, if the first switch signal is valid, the first lamp 10A is lit, and lighting of the second lamp 10B is dependent on the second switch signal. If the first signal is valid, the second lamp 10B is not lit unless the second switch signal is valid. Thus, outputting a different second switch signal meets the practical requirements of lowered brightness and energy conservation. For example, if the two lamps are lit simultaneously, maximum brightness of the lamps is 400 Nits; and if only one lamp is lit, maximum brightness of the lamps is 200 Nits.

In the exemplary embodiment, the first switch signal and the second switch signal can be set according to practical requirements. For example, at the time t (t is a dynamic real number), the amplitudes and the phases of the first switch signal and the second switch signal can be synchronous or asynchronous, and the polarities of the first switch signal and the second switch signal can be the same or opposite. Correspondingly, the amplitudes and the phases of the electrical signals output from the lamp control system 20A can be synchronous or asynchronous, and the polarities of the electrical signals can be the same or opposite. Accordingly, the electrical signals output from the lamp control system 20A can selectively light one or more of the lamps to achieve various brightness.

Figure 5:
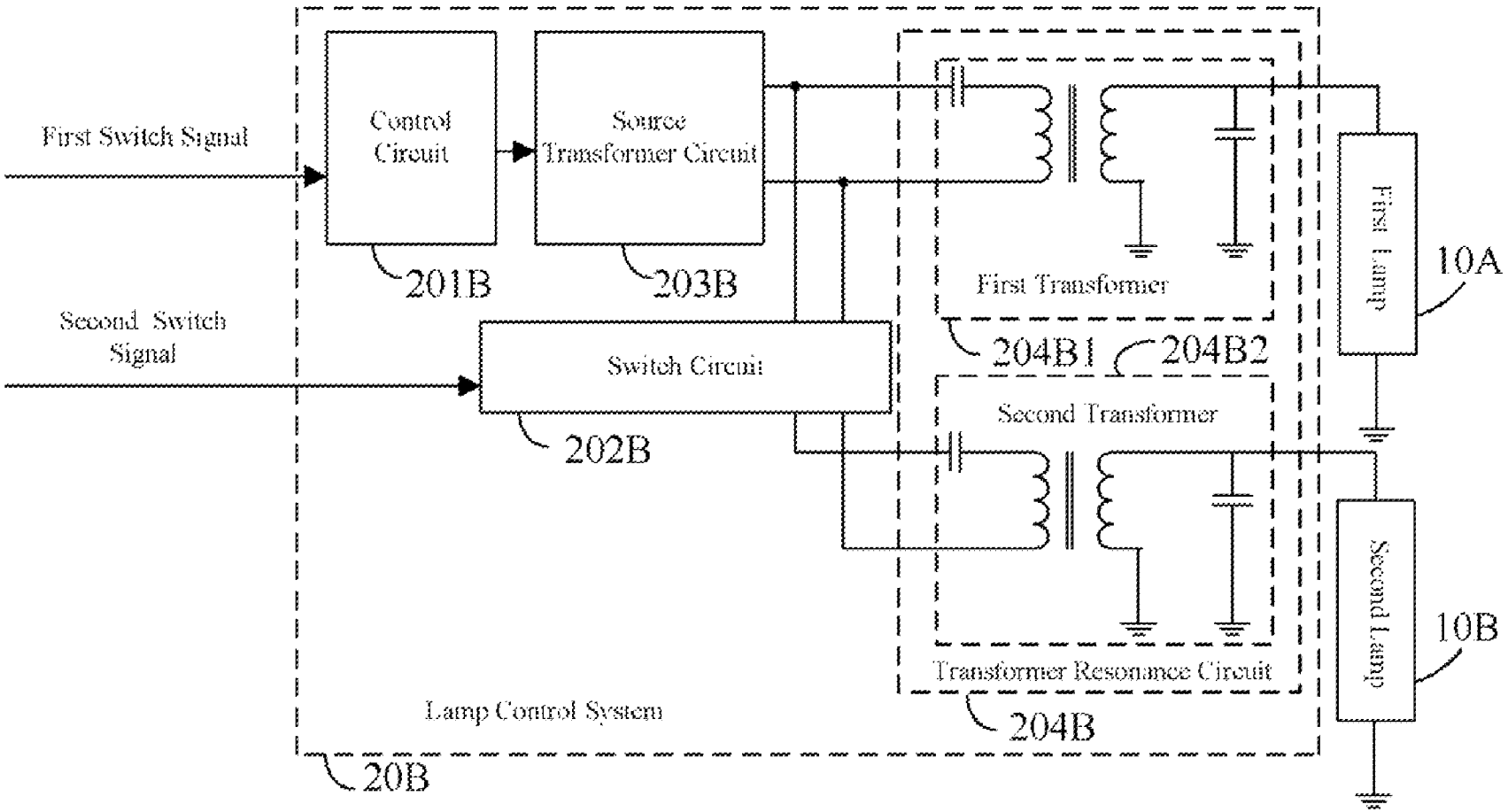
FIG. 5 is a function module diagram of another exemplary embodiment of the disclosure.

FIG. 5 is another exemplary embodiment showing a schematic diagram of function modules of another lamp control system 20B. In this embodiment, the LCD includes two discharge lamps, labeled as a first lamp 10A and a second lamp 10B, both electrically connected to the lamp control system 20B. The lamps may be CCFLs.

The lamp control system 20B includes a control circuit 201B, a switch circuit 202B, a source transformer circuit 203B and a transformer resonance circuit 204B. In the exemplary embodiment, the control circuit 201B receives a first switch signal and transforms it to a control signal. The first switch signal can be a digital square-wave signal or a power source signal, such as a DC signal. The source transformer circuit 203B is electrically connected to the control circuit 201B and transforms the control signal to an AC signal. The switch circuit 202B is electrically connected to the source transformer circuit 203B and impels the source transformer circuit 203B to transform a second switch signal to an AC signal and output the AC signal to the transformer resonance circuit 204B, consequently controlling the transformer resonance circuit 204B to generate electrical signals to drive the first lamp 10A and the second lamp 10B.

The transformer resonance circuit 204B comprises a first transformer 204B1 and a second transformer 204B2. Primary windings of the first transformer 204B1 and the second transformer 204B2 are electrically connected to the source transformer circuit 203B and the switch circuit 202B, respectively, while secondary windings thereof are electrically connected to the first lamp 10A and second lamp 10B, respectively. Therefore, the transformer resonance circuit 204B generates a first electrical signal and a second electrical signal to drive the first lamp 10A and the second lamp 10B. The electrical signals are transformed respectively by the AC signals output from the source transformer circuit 203B and the switch circuit 202B. FIG. 4 references the effect of the exemplary embodiment, while omitting the descriptions.

Similarly, in the exemplary embodiment, the first switch signal and the second switch signal can be set according to practical requirements. For example, at time t (t is a dynamic real number), the amplitudes and the phases of the first switch signal and the second switch signal can be synchronous or asynchronous, and the polarities of first switch signal and the second switch signal can be the same or opposite. Correspondingly, the amplitudes and the phases of the electrical signals output from the lamp control system 20B can be synchronous or asynchronous, and the polarities of the electrical signals can be the same or opposite. Therefore, the electrical signals output from the lamp control system 20B can selectively light one or more lamps to achieve various levels of brightness.

In the disclosure, the lamp control system can respectively control a plurality of pairs of CCFLs to be extinguished or lit by two groups of external switch signals. Particularly, when there is a requirement to light only one lamp, it is not necessary to light all lamps in the LCD panel, thereby achieving the goals of lighting and conservation of power.

In summary, the disclosure satisfies the requirements of a utility patent. However, the foregoing descriptions is only the exemplary embodiment of the disclosure, any equal modifications or ornaments made by any people who are familiar with the feature of disclosure are involved in the scope of the present patent application.

What is claimed is:

1. A lamp control system for driving a plurality of lamps, comprising:

a control circuit generating a control signal;

a source transformer circuit electrically connected to the control circuit and transforming the control signal to at least one AC signal, the source transformer circuit comprising at least two source transformers;

a transformer resonance circuit electrically connected between the source transformer circuit and the lamps transforming the at least one AC signal to one or more electrical signals to drive one or more lamps; and a switch circuit electrically connected to the source transformer circuit and driving the source transformer circuit to output the at least one AC signal to the transformer resonance circuit, thereby driving the transformer resonance circuit to generate one or more electrical signals to drive one or more lamps.

2. The lamp control system as claimed in claim 1, wherein the control circuit outputs the control signal according to a first switch signal.

3. The lamp control system as claimed in claim 2, wherein the transformer resonance circuit comprises:

a first transformer, a primary winding thereof electrically connected to the source transformer circuit, a secondary winding thereof connected to at least one of the lamps, the first transformer transforming the AC signal output from the source transformer circuit to the electrical signal to drive one of the lamps; and a second transformer, with a primary winding thereof electrically connected to the source transformer circuit, and a secondary winding thereof connected to another lamp, the second transformer transforming the AC signal output from the source transformer circuit to the electrical signal to drive another lamp.

4. The lamp control system as claimed in claim 3, wherein the switch circuit is electrically connected between the source transformer circuit and the second transformer and drives the source transformer circuit to output the AC signal to the second transformer according to a second switch signal.

5. The lamp control system as claimed in claim 3, wherein the source transformer circuit comprises:

a first source transformer, connected to the first transformer and transforming control signal output from the control circuit to a first AC signal and transmitting the first AC signal to the first transformer; and a second source transformer, connected to the second transformer and transforming control signal output from the control circuit to a second AC signal and transmitting the second AC signal to the second transformer.

6. The lamp control system as claimed in claim 5, wherein the switch circuit is electrically connected between the control circuit and the second source transformer and drives control circuit output of the control signal to the second source transformer circuit according to a second switch signal.

* * * * *